United States Patent [19]

Smrt

[11] Patent Number: 4,895,304

[45] Date of Patent: Jan. 23, 1990

[54] SPRAYING APPARATUS

[75] Inventor: Thomas J. Smrt, Cary, Ill.

[73] Assignee: Fox Valley Systems, Inc., Cary, Ill.

[21] Appl. No.: 325,017

[22] Filed: Mar. 16, 1989

Related U.S. Application Data

[63] Continuation of Ser. No. 3,501, Jan. 15, 1987, abandoned, which is a continuation of Ser. No. 278,164, Jun. 29, 1981, Pat. No. 4,641,780.

[51] Int. Cl.[4] ..... B05B 9/04

[52] U.S. Cl. ..... 239/150; 239/754

[58] Field of Search ..... 239/150, 151, 754; 222/108; 118/301, 303, 500, 504

[56] References Cited

U.S. PATENT DOCUMENTS

| | | | |
|---|---|---|---|
| 1,188,131 | 6/1916 | Agee | 239/150 |
| 2,221,908 | 11/1940 | Bossi | 239/150 X |
| 2,317,288 | 4/1943 | McCubbin | 239/150 |
| 2,324,478 | 7/1943 | Bleakley et al. . | |
| 2,351,719 | 6/1944 | Stahl | 239/150 |
| 3,157,316 | 11/1964 | Garber . | |
| 3,796,353 | 3/1974 | Smrt . | |
| 4,262,821 | 4/1981 | Smrt | 222/162 |
| 4,276,852 | 7/1981 | Adams | 118/301 X |
| 4,545,531 | 10/1985 | Williams | 239/150 |
| 4,641,780 | 2/1987 | Smrt . | |

FOREIGN PATENT DOCUMENTS

| | | |
|---|---|---|
| 1147251 | 4/1963 | Fed. Rep. of Germany . |
| 6931639 | 8/1969 | Fed. Rep. of Germany . |
| 7492753 | 12/1974 | Fed. Rep. of Germany . |
| 2272745 | 12/1975 | France . |
| 535189 | 4/1941 | United Kingdom . |
| 536209 | 5/1941 | United Kingdom . |
| 767616 | 2/1957 | United Kingdom . |
| 1456411 | 11/1976 | United Kingdom . |

*Primary Examiner*—Andres Kashnikow
*Assistant Examiner*—Patrict N. Burkhart
*Attorney, Agent, or Firm*—Leydig, Voit & Mayer

[57] ABSTRACT

A spraying apparatus is provided with a pair of discs for masking the material which is sprayed. The discs are mounted on an axle which is free to move up and down within the spraying apparatus as the spraying apparatus moves over the surface which is being sprayed. Each of the discs includes an axially extending flange which provides a well for retaining material which is sprayed onto the disc.

6 Claims, 2 Drawing Sheets

SPRAYING APPARATUS

RELATED APPLICATION

This application is a continuation, of U.S. patent application Ser. No. 003,501, filed Jan. 15, 1987 now abandoned, which in turn is a continuation of application U.S. patent Ser. No. 278,164, filed June 29, 1981, now U.S. Pat. No. 4,641,780.

BACKGROUND AND SUMMARY

This invention relates to a spraying apparatus, and, more particularly, to a spraying apparatus which includes a pair of masking discs for defining sharp edges to the sprayed material.

This invention is a variation of marking or spraying machines described in my previous patents U.S. Pat. Nos. 3,485,206, 3,700,144, 3,796,353, 3,817,429, 3,871,557, 4,126,273, and 4,262,821.

British Patent No. 1,456,411 describes a paint spraying device which includes a pair of shields which are mounted on the axle of the sprayer for masking the paint and thereby defining a stripe. However, as more and more paint is sprayed onto these shields, the paint can accumulate to the point at which the paint drips from the shields onto the surface which is being sprayed. Also, since the shields are mounted directly on the disc axle, the shields will move up and down as the discs engage stones, uneven areas of the surface, or other objects which cause variations in the surface.

The invention provides an improved masking disc which includes a flange for retaining the paint which is sprayed onto the disc edge. The flange terminates in a radially inwardly extending retaining lip which provides a well for holding the paint within the flange. The edge of the flange is spaced from the surface which is being sprayed by a rim on the flange. The masking discs are mounted on an axle which is supported by the spraying apparatus for generally vertical movement. The wheels of the apparatus are mounted on separate axles, and the masking discs can move up and down independently as the wheels and the discs engage variations in the surface which is being sprayed.

DESCRIPTION OF THE DRAWING

The invention will be explained in conjunction with an illustrated embodiment shown in the accompanying drawing, in which--

DESCRIPTION OF THE SPECIFIC EMBODIMENT

Figure 1:
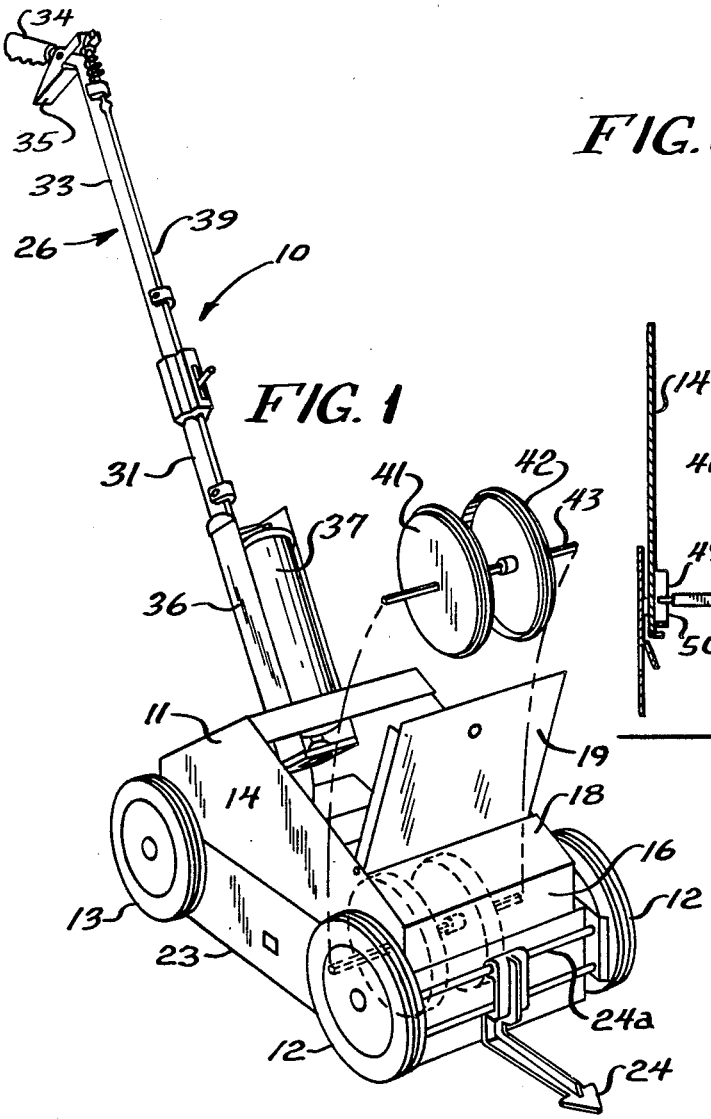
FIG. 1 is a perspective view, partially exploded of a spraying apparatus equipped with a pair of masking discs.
Figures 6, 7, 8, 9:
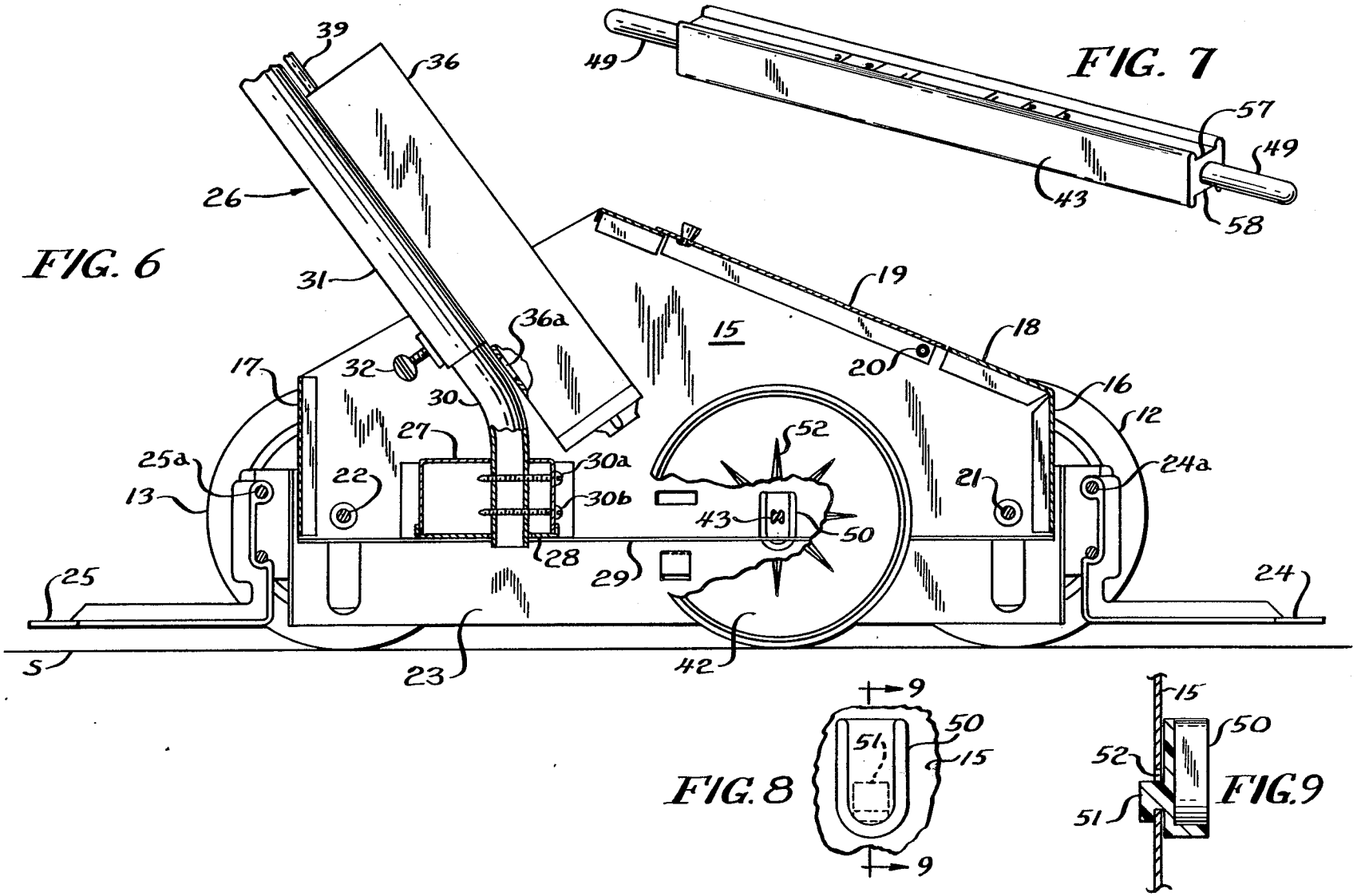
FIG. 6 is a sectional view, partially broken away, of the spraying apparatus.
FIG. 7 is an enlarged perspective view of the axle for the masking disc.
FIG. 8 is an enlarged fragmentary view of one of the U-shaped brackets.
FIG. 9 is a fragmentary sectional view taken along the line 9—9 of FIG. 8.

Referring to FIGS. 1 and 6, a spraying apparatus 10 includes a housing or frame 11, a pair of front wheels 12, and a pair of rear wheels 13. The spraying apparatus has some features in common with the devices described in U.S. Pat. Nos. 3,700,144, 3,796,353, and 4,262,821. The housing includes a pair of side walls 14 and 15, front and rear walls 16 and 17, and an inclined top wall 18. Part of the top wall is formed by a cover or door 19 which is pivotally supported by a pair of rivets 20 (FIG. 6) which extend through the side walls. If desired the door can be formed from transparent material so that the stripe can be viewed through the door.

The front wheels 12 are supported by an axle 21 which extends between the side walls, and the rear wheels 13 are supported by an axle 22 which extends between the side walls. The wheels roll over the surface S which is to be sprayed.

A rectangular windscreen 23 is supported by the axles and extends below the bottom edge of the housing toward the surface S. Front and rear arrows 24 and 25 are mounted on rods **24*a* and 25*a***, respectively, which extend between the sides of the windscreen. The arrows assist in ensuring that the spraying apparatus will be wheeled along the desired path.

A handle assembly 26 is supported within the spraying apparatus by a pair of channels 27 and 28 (FIG. 6) which extend between the side walls and which are supported by a pair of inwardly turned flanges 29 at the bottom of the side walls. The handle assembly is similar to the handle assembly described in U.S. Pat. No. 4,262,821.

A lower tube 30 extends through an opening in each of the channels 27 and 28, and is secured by screws **30*a* and 30*b*. An intermediate tube 31 is telescopingly received over the lower tube and is secured by a thumbscrew 32. An upper tube 33 (FIG. 1) is inserted into the upper end of the intermediate tube, and a handle grip 34 and trigger 35** are mounted on the upper end of the upper tube.

A can holder 36 is mounted on the intermediate tube and holds an aerosol spray can 37. As described in U.S. Pat. No. 4,262,821, the aerosol can includes a nozzle 38 (FIG. 2) which is seated within an opening in the bottom of the can holder, and a trigger rod 39 can be moved downwardly by the trigger 35 to move the aerosol can toward the bottom of the can holder. The valve of the aerosol can is thereby opened, and the contents of the can are sprayed toward the surface S.

The width of the stripe which is sprayed can be varied by moving the intermediate tube 31 up or down with respect to the lower tube. A stripe-adjusting scale can be provided by placing numbers on the lower tube 30 and making an opening **36*a* (FIG. 6**) in the can holder below the lower end of the intermediate tube through which the numbers can be viewed. As the intermediate tube and the can holder are moved upwardly along the lower tube, the aerosol can is moved farther away from the surface and the stripe will get wider.

Figure 4:
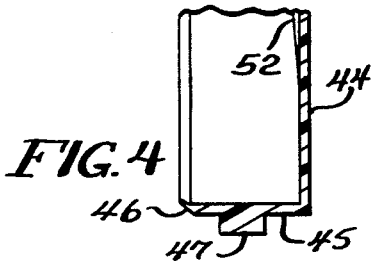
FIG. 4 is a fragmentary sectional view of one of the masking discs taken along the line 4—4 of FIG. 3.
Figure 3:
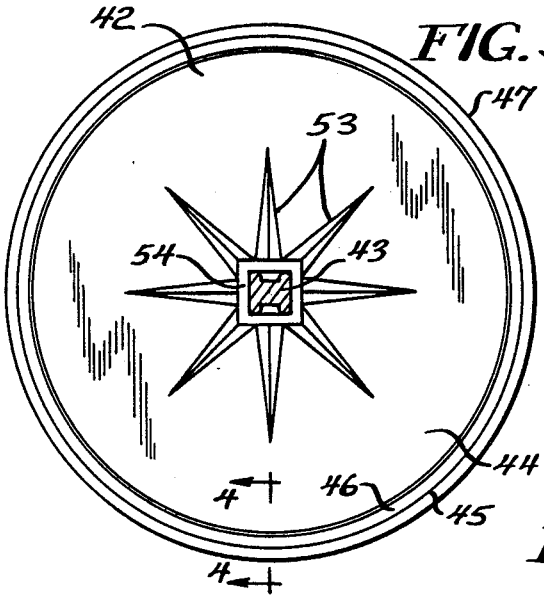
FIG. 3 is an enlarged side elevational view of one of the masking discs taken along the line 3—3 of FIG. 2.

The stripe is provided with sharp edges by a pair of masking discs 41 and 42 which are mounted on an axle 43. Referring to FIGS. 3 and 4, each of the discs includes a circular wall 44 and an axially extending flange 45 which extends toward the other disc. The outer edge of the flange terminates in a radially inwardly extending retaining lip 46. The lip and the flange thereby define a retaining well for holding paint which is sprayed onto the disc flange. A circumferentially extending rim 47 extends around the outside of the flange and engages the surface S which is being sprayed. The rim is spaced from the outer edge of the flange so that the edge is spaced from the surface. The rim helps to ensure that any paint which might flow onto the outer surface of the flange does not contact the surface S as the disc is wheeled over the surface. Although the particular rim illustrated has a smooth surface for contacting the surface S, the rim can be serrated (as noted by the dotted lines on FIG. 3) to minimize the contact between the rim and the surface S.

The axle 43 has a non-round cross section so that the discs are non-rotatably mounted on the axle. In the particular embodiment illustrated, the axle has a generally H-shaped cross section (see particularly FIG. 7) and terminates in a pair of cylindrical end portions 49 with rounded ends for less friction. The H-shape portion of the axle mates with a rectangular opening in each of the discs.

The cylindrical end portions 49 are positioned within molded plastic U-shaped brackets 50 (FIGS. 2, 6, 8, and 9). Each bracket 50 includes a generally L-shaped mounting finger 51 (FIG. 9) which extends through a keyhole slot 52 in the side wall. The brackets are positioned so that the cylindrical end portions of the axle are above the bottoms of the brackets when the spraying apparatus is on a level surface. As the spraying apparatus is wheeled over the surface, the discs will also rotate over the surface. If the surface is bumpy or uneven, the masking discs are free to move up or down independently of the wheels 12 and 13 in order to remain in engagement with the surface.

A plurality of ribs 53 on the circular wall 44 of each of the masking discs extend radially outwardly from the hub 54 (FIG. 3) of the disc. The ribs catch paint which flows across the surface of the circular wall as the disc rotates and helps to prevent an excessive amount of paint from accumulating in the portion of the retaining well which is adjacent the surface.

Figure 5:
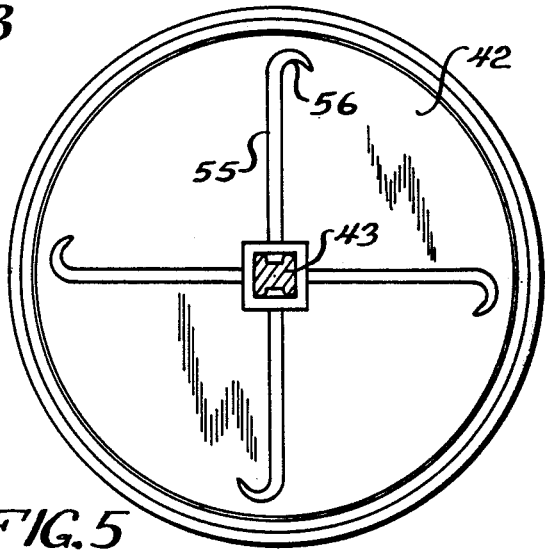
FIG. 5 is a side elevational view similar to FIG. 3 showing a modified masking disc.

An alternate form of ribbing is shown in FIG. 5. The ribs 55 terminate in cup-shaped end portions 56 which prevent the paint from dripping into the retaining well.

Referring to FIG. 7, the H shape of the axle provides a pair of recessed surfaces 57 and 58 which can be embossed or labeled with a set of numbers for each disc. The numbers indicate the spacing between the discs, and the width of the stripe which is to be sprayed can be adjusted as desired by moving the disc toward or away from each other along the axle.

Figure 2:
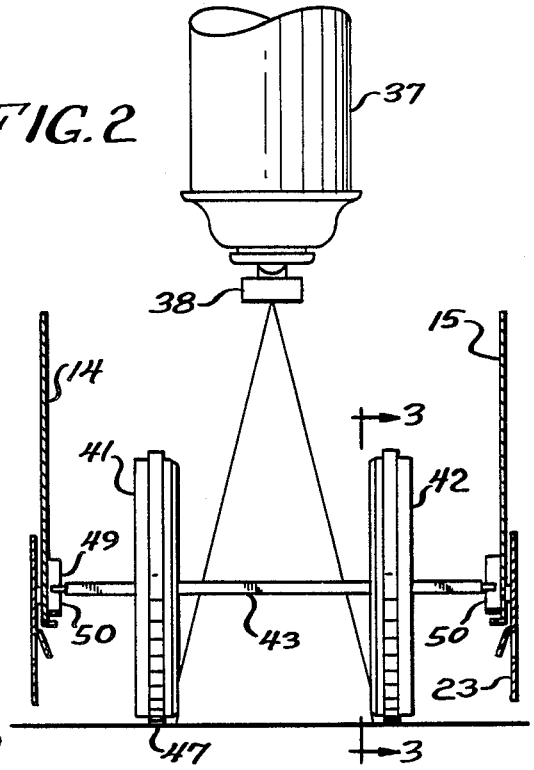
FIG. 2 is a sectional view through the spraying apparatus showing the, masking discs.

The operation of the masking discs is shown in FIG. 2. The spacing between the discs is adjusted so that the inner edges of the discs are just on the edge of the spray pattern. The inner edges of the disc mask the spray and provide a stripe with sharp, well-defined edges. The paint or other sprayed material which contacts the masking discs is retained within the wells.

When the retaining wells are filled with paint, the discs can be quickly replaced by withdrawing the discs and the axle through the cover 19 as shown in FIG. 1. Since the axle rides freely within the U-shaped support brackets, the axle can be easily removed and reinserted. When sharply defined edges for the stripes are not needed, the masking discs can be removed, and the width of the stripe can be adjusted solely by moving the aerosol can holder up or down along the bottom tube 30 of the handle assembly.

If desired, each masking disc can be provided with a pair of retaining wells, one on each side of the circular wall 44, by having a flange on each side of the circular wall. When one retaining well is filled with paint, the disc can be removed from the axle and reversed.

While in the foregoing specification a detailed description of a specific embodiment of the invention was set forth for the purpose of illustration, it will be understood that many of the details hereingiven may be varied considerably by those skilled in the art without departing from the spirit and scope of the invention.

I claim:

1. A disc assembly used with a spraying apparatus for defining sharp edges in sprayed material provided by a material container of the spraying apparatus, said spraying apparatus being moveable on a supporting surface which receives the sprayed material, said disc assembly comprising: an axle member; and a pair of spaced apart discs mounted on said axle member; each disc including: a circular wall segment; a flange segment which extends axially outward from the wall segment toward the other disc and which lies a predetermined distance radially inward of the circumference of said disc, said flange segment receiving the edges of the sprayed material; and a rim segment which projects radially outward from the wall segment and which engages the supporting surface on which the spraying apparatus discharges the sprayed material, said rim segment disposed a predetermined distance axially away from the inner distal end of said flange wherein the inner distal end of said flange segment defines a radially inwardly extending retaining lip and said flange segment defines a retaining well for holding sprayed material.

2. The assembly of claim 1, wherein each one of said discs includes a plurality of generally radially extending ribs on the circular wall for trapping sprayed material and directing the sprayed material to said flange segment.

3. The assembly of claim 1, wherein the rim is serrated.

4. The assembly of claim 1, wherein the discs are axially movable to permit adjustment of the space between them.

5. The assembly of claim 1, 2, 3, 4, wherein in each disc is a one-piece, integrally molded unit.

6. A movable spraying apparatus for spraying a layer material onto a surface over which the apparatus moves, said apparatus comprising:

(a) a frame, including means for holding a container of material in a position in which the material may be sprayed on the surface and means for adjusting the distance from the container to the surface to control the width of the layer of material on the surface;

(b) wheel means rotatably mounted on the frame for supporting the frame and allowing the frame to move over the surface;

(c) handle means secured to the frame for controlling the movement of the frame;

(d) actuating means secured to the frame for discharging material from the container;

(e) an axle member disposed on the frame; and (f) a pair of spaced apart discs mounted on the axle member; each disc including: a circular wall segment; a flange segment which extends axially outward from the wall segment toward the other disc and which lies a predetermined distance radially inward of the circumference of said disc, said flange segment receiving edge portions of the sprayed material; and a rim segment which projects radially outward from the wall segment and which engages the supporting surface on which the spraying apparatus discharges the sprayed material, said rim segment disposed a predetermined distance axially away from the inner distal end of said flange segment being axially movable to permit adjustment of the space between them wherein the inner distal end of said flange segment defines a radially inwardly extending retaining lip and said flange segment defines a retaining well for holding sprayed material.

* * * * *

Disclaimer 4,895,304.—*Thomas J. Smrt,* Cary, Ill. SPRAYING APPARATUS. Patent dated Jan. 23, 1990. Disclaimer filed Jan. 25, 1990, by the assignee, Fox Valley System, Inc.

The term of this patent subsequent to February 10, 2004, has been disclaimed.

[*Official Gazette May 1, 1990* ]